US005747211A

United States Patent [19]

Hagi et al.

[11] Patent Number: 5,747,211

[45] Date of Patent: May 5, 1998

[54] TONER FOR DEVELOPING ELECTROSTATIC LATENT IMAGES

[75] Inventors: Masayuki Hagi, Takatsuki; Junichi Tamaoki, Sakai; Takeshi Arai, Akashi; Hiroyuki Fukuda, Kobe, all of Japan

[73] Assignee: Minolta Co., Ltd., Osaka, Japan

[21] Appl. No.: 803,252

[22] Filed: Feb. 20, 1997

[30] Foreign Application Priority Data

Feb. 20, 1996 [JP] Japan ..... 8-031964
Feb. 29, 1996 [JP] Japan ..... 8-043272

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,623,605 | 11/1986 | Kato et al. | 430/110 |
| 4,626,487 | 12/1986 | Mitsuhashi et al. | 430/109 |
| 4,652,509 | 3/1987 | Shirose et al. | 430/110 |
| 4,904,558 | 2/1990 | Nagatsuka et al. | 430/122 |
| 4,933,251 | 6/1990 | Ichimura et al. | 430/110 |
| 5,155,000 | 10/1992 | Matsumura et al. | 430/110 |
| 5,219,696 | 6/1993 | Demizu et al. | 430/110 |
| 5,272,040 | 12/1993 | Nakasawa et al. | 430/110 |
| 5,372,905 | 12/1994 | Deusser et al. | 430/110 |
| 5,615,326 | 3/1997 | Kanbayashi et al. | 430/110 |

*Primary Examiner*—Roland Martin
*Attorney, Agent, or Firm*—Burns, Doane, Swecker & Mathis, LLP

[57] ABSTRACT

A toner for developing electrostatic latent images comprising: colored resin particles which include a binder resin and a colorant, and hydrophobic titania micro particles which are obtained by surface treating of anatase-type titania micro particles having average primary particle size of 30 to 90 nm with a hydrophobicity imparting agent and satisfy following relationship:

$$S=1125/D+k$$

wherein S expresses BET specific surface area ($m^2/g$) of hydrophobic titania micro particles, D expresses average primary particle size (nm) of anatase-type titania micro particles, and k expresses a constant of 0 to 60.

23 Claims, No Drawings

TONER FOR DEVELOPING ELECTROSTATIC LATENT IMAGES

BACKGROUND OF THE INVENTION

1. Field of the Invention

The present invention relates to a toner for developing electrostatic latent images, and specifically relates to a toner for developing electrostatic latent images in full color image forming apparatuses such as full color electrostatic coping machines, full color laser beam printers and the like.

2. Description of the Related Art

Copying machines, printers, facsimile machines and the like which accomplish image formation using toner to develop electrostatic latent images formed on the surface of electrostatic latent image-bearing members such as photosensitive members and the like, and transfer the toner image onto a recording member such as a recording sheet have come into widespread use, and in recent years, full color image forming apparatuses which reproduce multi-color images by overlaying a plurality of colors of toner are being used.

Such toner for developing electrostatic latent images essentially includes colored resin particles contained in a binder resin as a fixing component having a colorant, and mixed with an exterior coating of silica for the purpose of improving flow characteristics. Normally, silica is subjected to surface treating with a hydrophobicity imparting agent such as silane coupling agent or the like for the purpose of improving the environmental stability of the toner and particularly to stabilize the amount of charge relative to fluctuations of humidity, but when silica treated with a hydrophobicity imparting agent is used, the negative chargeability of the toner is strengthened and produces a reduction in image density due to the increased charge, and inadequate environmental stability results. There is well known art using titania as a fluidizing agent to eliminate the aforementioned disadvantages.

Although the use of titania is effective in improving environmental stability, a large amount of titania must be added because titania is only slightly as effective at improving flow characteristics compared to silica, such that the chargeability of negative charging toner is reduced, causing image fog and the accumulation of spent titania in the carrier during printing, and leading to filming on the surface of the photosensitive member. When the amount of added titania is reduced, not only are flow characteristics inadequate, but new disadvantages arise insofar as toner storage heat resistance is reduced, toner particles themselves as well as toner and carrier particles flocculate during printing, and nonprinting white spots appear in solid images caused by the flocculants.

SUMMARY OF THE INVENTION

An object of the present invention is to provide a toner for developing electrostatic latent images which eliminates the previously described disadvantages.

Another object of the present invention is to provide a toner for developing electrostatic latent images having excellent environmental stability by minimizing the range of fluctuation of the amount of toner charge caused by humidity and temperature fluctuation, and eliminates the problems of storage heat resistance and nonprinting white spots.

A further object of the present invention a toner for developing electrostatic latent images which provides excellent flow characteristics, and does not cause filming of the electrostatic latent image-bearing member during printing, nor image fog in non-image areas, nor nonprinting white spots on images.

A still further object of the present invention is to provide a toner for developing electrostatic latent images which is suitable for forming full color images.

These objects of the invention are achieved by providing a toner for developing electrostatic latent images comprising colored resin particles which include a binder resin and a colorant, and hydrophobic titania micro particles which are obtained by surface treating of anatase-type titania micro particles having average primary particle size of 30 to 90 nm with a hydrophobicity imparting agent and satisfy following relationship:

$$S=1125/D+k$$

wherein S expresses BET specific surface area ($m^2/g$) of hydrophobic titania micro particles, D expresses average primary particle size (nm) of anatase-type titania micro particles, and k expresses a constant of 0 to 60.

These objects of the invention are further achieved by providing a toner for developing electrostatic latent images comprising colored resin particles which include a binder resin and a colorant, hydrophobic silica micro particles which are obtained by surface treating of silica micro particles having average primary particle size of 5 to 25 nm, and hydrophobic titania micro particles which are obtained by surface treating of anatase-type titania micro particles having average primary particle size of 30 to 90 nm with a hydrophobicity imparting agent and satisfy the same relationship as described above:

$$S=1125/D+k$$

The present invention provides a toner for developing electrostatic latent images for use in full color image forming apparatuses which reproduce multi-color images using magenta toner, cyan toner, yellow toner, and black toner.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

The present invention eliminates the previously described disadvantages by using titania micro particles having a specific crystal system and having specific average primary particle size as well as BET specific surface area as the titania micro particles externally added to and mixed with toner particles (colored resin particles), or by using in combination silica micro particles having specific average primary particle size as well as BET specific surface area.

The present invention uses anatase-type titania having a average primary particle size of 30 to 90 nm, and preferably 35 to 80 nm, and ideally 40 to 70 nm, which satisfies the relationship:

$$S=1125/D+k$$

wherein S expresses the BET specific surface area ($m^2/g$) of hydrophobic titania micro particles, D expresses the average primary particle size (nm) of anatase-type titania micro particles, and k expresses a constant of 0 to 60, and preferably a constant of 10 to 55, and ideally a constant of 15 to 45.

Although hydrophobic silica is used as a normal toner exterior additive, the use of hydrophobic silica produces a particularly adverse affect on the environmental stability of the amount of toner charge. The use of the previously described titania as an exterior additive improves the environmental stability of the developer. Furthermore, the titania becomes a steric hindrance due to its presence on the surface of the toner when the specific titania is used as an exterior additive, thereby eliminating the previously mentioned problem of nonprinting white spots in images by preventing flocculation of the toner particles themselves as well as flocculation of toner and carrier.

Normal anatase-type titania is needle-like or rod-like micro particles having an average primary particle size of about 200 nm, but the titania particles used in the present invention are not sintered to needle-like particles, and have a disc-like shape. The BET specific surface area is a physical value dependent on differences of surface condition, particle size, and flocculation condition of the micro particles; anatase-type titania which satisfies the previously mentioned relationship between the BET specific surface area and average primary particle size is believed to have excellent adhesion characteristics and mixing/dispersion characteristics relative to toner. The provision of BET specific surface area of titania particles after hydrophobicity imparting processing in the present invention stipulates the final specific surface area when added to the exterior of the toner and after hydrophobicity imparting processing because the specific surface area may vary due to differences in the hydrophobicity imparting methods even for titania particle having identical specific surface areas before hydrophobicity imparting processing.

The aforementioned anatase-type titania can be manufactured by sulfuric acid method, and can be manufactured by regulating particle size at 30 to 90 nm by controlling the reaction speed of hydrolysis in a process to obtain hydrous titanium oxide, and controlling the calcination time and calcination temperature in a calcination process after washing the titanium oxide, and then pulverizing the calcined particles into respective particles. The particle size of the titanium hydroxide can be reduced by increasing the speed of the hydrolysis reaction., or the particle size of the titania particles can be reduced compared to calcination at normal temperature of about 600° C. by reducing the calcination temperature to about 300° C. Regulating particle size mainly at the stage of obtaining hydrous titanium oxide and producing the titania particles at low calcination temperature of about 300° C. are desirable.

When using titania other than anatase-type titania, e.g., rutile-type titania, the aforementioned effectiveness cannot be sufficiently attained, and is particularly undesirable inasmuch as the effectiveness of imparting improved flow characteristics to the toner is markedly reduced. This reduction is thought to arise from differences in the shape of the titania particles and differences in the surface conditions and properties produced by the different types of crystals. When the particle size of anatase-type titania particles is less than 30 nm, the titania readily becomes embedded in the toner particles due to the mixing stress within the developing device during printing, which results in reduced effectiveness in suppressing flocculation in the developer and leads to nonprinting white spots in solid images. When the particles size is greater than 90 nm, the toner covering rate is reduced and produces reduced effectiveness in flow characteristics, storage heat resistance, and prevention of nonprinting white spots, and increases the amount of additive necessary to improve the reductions, thereby reducing the toner charge level.

When the value of k in the previously mentioned equation is greater than 60, there is an increase in the fluctuation of the amount of toner charge due to environmental fluctuations, and fogging occurs in the non-image areas due to the low charge particularly under conditions of high temperature and high humidity. When the value of k is less than 0 (zero), toner flow characteristics decrease, and image density is reduced due to the elevation of toner charge under conditions of low temperature and low humidity.

In the present invention, the anatase-type titania is subjected to surface treating using hydrophobicity imparting agents to achieve environmental stability of the toner and particularly to suppress changes in the amount of toner charge due to the influence of humidity. In the previously mentioned relationships, the average primary particle size is the average primary particle size of the titania before hydrophobicity imparting processing, and the BET specific surface area is the BET specific surface area of the titania after hydrophobicity imparting processing.

Silane coupling agent, titanate coupling agent, silicone oil, silicone vanish and the like may be used as hydrophobicity imparting agents. Examples of useful silane coupling agents include trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-oxypropyltrimethoxysilane methacrylate, vinyltriacetoxysilane and the like. Examples of useful silicone oil include dimethylpolysiloxane, methylhydrogen polysiloxane, methylphenylpolysiloxane and the like.

Surface treating of titania using the aforementioned hydrophobicity imparting agents may be accomplished using a dry method wherein the hydrophobicity imparting agent is diluted with solvent and the dilute solution is added to the titania, and the mixture is heated, dried, then pulverized into respective particles, or using a wet method wherein the titania is dispersed in an aqueous system to form a slurry onto which the hydrophobicity imparting agent is added and mixed, and this mixture is heated, dried, then pulverized into respective particles. It is particularly desirable to accomplish hydrophobicity imparting processing of titania in an aqueous system from the perspective of uniformity of the surface process of the titania with hydrophobicity imparting agent, and prevention of flocculation of titania particles.

The amount of the aforementioned titania added to toner particles is desirably 0.1 to 3.0 percent-by-weight (hereinafter referred to as "wt %"), preferably 0.2 to 2.0 wt %, and ideally 0.3 to 1.5 wt %. An amount of added titania less than 0.1 wt % is undesirable because inadequate effectiveness is obtained by the addition, and an amount in excess of 3.0 wt % is undesirable because toner charge is reduced and spent carrier is readily produced.

In the toner of the present embodiment, the aforementioned titania may be used in combination with silica to improve flow characteristics, adjustment of negative charging characteristics, and image properties during printing. The silica used desirably has an average primary particle size of 5 to 25 nm, an preferably 10 to 20 nm, and after hydrophobicity imparting processing with a hydrophobicity imparting agent desirably has a BET specific surface area of 80 to 250 $m^2/g$, and preferably 100 to 200 $m^2/g$. When the average primary particle size is less than 5 nm, the titania readily becomes embedded in the toner particles so as to cause great fluctuation of characteristics during printing, whereas when the average primary particle size is greater than 25 nm, the covering rate of both silica and the titania used in combination relative to the toner is inadequate, and produces a decrease in heat resistance and effectiveness in suppressing flocculation of the develop, which readily causes non-printing white spots in solid images. When the BET specific surface area is less than 80 $m^2/g$, it is difficult to adjust the negative charging characteristics and flow characteristics when used in combination with titania, and when the BET specific surface area exceeds 250 $m^2/g$, sufficient environmental stability cannot be obtained even when used in combination with titania.

The aforementioned silica is subjected to hydrophobicity imparting processing from the perspective of environmental stability, and examples of useful hydrophobicity imparting agents to accomplish hydrophobicity imparting of the silica include silicone oil and various types of coupling agents including silane, titanate, aluminum, zirco-aluminate and the like. It is desirable that such hydrophobicity imparting agents contain hexamethyldisilazane from the perspective of fast hydrophobicity imparting processing.

The aforementioned titania micro particles and silica micro particles desirably comprise a total weight relative to the colored resin particles of 0.3 to 3.0 wt %, preferably 0.5 to 2.0 wt %, and ideally 0.8 to 1.5 wt %. It is further desirable that the amount of added titania micro particles exceed the amount of silica micro particles, their weight ratio being desirably 10:1 to 10:9, and preferably 10:2 to 10:7. Sufficient effectiveness is obtained by using titania and silica micro particles within the ranges specified above.

Well known resins may be used as the binder resin of the toner, e.g., styrene or substituted styrene resins, acrylic resins such as alkylacrylate and alkylmethacrylate, styrene-acrylic copolymer resin, polyester resin, epoxy resin, silicone resin, olefin resin, amide resin and the like, which may be used individually or in combination.

The binder resin used in full color toners such as cyan toner, magenta toner, yellow toner, and black toner is preferably polyester resin or epoxy resin having a number-average molecular weight (Mn) of 3000 to 6000, and preferably 3500 to 5500, and a ratio of weight-average molecular weight (Mw) to number-average molecular weight ratio Mw/Mn of 2 to 6, and preferably 2.5 to 5.5, glass transition temperature of 50° to 70° C., and preferably 55° to 65° C., and softening point of 90° to 110° C., and preferably 90° to 105° C.

When the number-average molecular weight of the binder resin is less than 3000, image defects arise inasmuch as a full color image will peel from the paper when the sheet is folded (poor folding fixing characteristics), and when a weight of 6000 is exceeds, the thermal fusibility is reduced during fixing, thereby reducing the fixing strength. When the Mw/Mn ratio is less than 2, high temperature offset readily occurs, whereas when the ratio is greater than 6, the sharp melt characteristics are reduced during fixing which leads to reduced transmittancy of the toner and reduced color mixing when forming full color images. When the glass transition temperature is less than 50° C., there is inadequate toner heat resistance and toner easily flocculates during storage, whereas when the glass transition temperature exceeds 75° C., fixing characteristics are reduced and color mixing is reduced when forming full color images. When the softening point is less than 90° C., high temperature offset readily occurs, whereas when the softening point exceeds 110° C., fixing strength, transmittancy, color mixing, and gloss of full color images are reduced. Usable polyester resins may contain ether diphenol as an alcohol component, and aromatic dicarboxylic acid as an acid component.

Examples of useful ether diphenols include polyoxypropylene(2,2)-2,2-bis(4-hydroxyphenyl)propane, polyoxyethylene(2)-2,2-bis(4-hydroxyphenyl)propane and the like.

Examples of materials which may be used in combination with the aforementioned ether diphenols include diols such as ethylene glycol, diethylene glycol, triethylene glycol, 1,2-propylene glycol, 1,3-propylene glycol, 1,4-butanediol, neopentylglycol and the like, sorbitol, 1,2,3,6-hexanetetrol, 1,4-sorbitane, pentaerythritol, dipentaerythritol, tripentaerythritol, 1,2,4-butanetriol, 1,2,5-pentanetriol, gylcerol, 2-methylpropanetriol, 2-methyl-1,2,4-butanetriol, trimethylol ethane, trimethylol propane, 1,3,5-trihydroxymethylbenzene and the like.

Examples of usable aromatic dicarboxylic acids include terephthalic acid, isophthalic acid and the like, and acid anhydrides and low-molecular alkyl esters thereof.

Further examples of useful dicarboxylic acids include aliphatic dicarboxylic acids such as fumaric acid, maleic acid, succinic acid, alkyl or alkenylsuccinic acid having 4 to 18 carbon atoms, acid anhydrides or low-molecular alkyl esters thereof.

Polyvalent carboxylic acids such as 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylenecarboxy propane, 1,2,4-cyclohexane tricarboxylic acid, tetra(methylenecarboxyl)methane, 1,2,7,8-octanetetracarboxylic acid, pyromellitic acid, and anhydrides and low-molecular alkyl esters thereof may be used for the purpose of adjusting the acid value of the polyester resin and improving resin strength when used in small amounts within a range which does not impair transmittancy. Transmittancy need not be a concern in the case of black toner.

Well known colorants may be used in the toner, and the use of such colorants is not specifically restricted.

Colorants used in color toners may be obtained by a master batch process or flashing process to improve the dispersability of the colorant. The colorant content of the toner is desirably 2 to 15 parts-by-weight (hereinafter referred to as "pbw") relative to 100 pbw of binder resin.

In addition to the aforementioned colorants, various other additives such as charge control agents, magnetic powder, waxes and the like may be added to the toner.

Well known charge control agents may be used, and the use of such charge control agents is not specifically limited. The charge control agents used in color toners may be colorless, white, or pale color which does not adversely affect light transmittance or tone of the color toner, e.g., salicylic acid metal complex such as salicylic acid derivatives of zinc complex, calix arene compounds, organic boron compounds, quaternary ammonium salts with fluorine may be used as charge control agents. Examples of useful salicylic acid metal complexes are disclosed in, for example, Japanese Unexamined Patent Application Nos. SHO 53-127726, and SHO 62-145255, examples of useful calix arene compounds are disclosed in, for example, Japanese Unexamined Patent Application No. HEI 2-201378, examples of useful organic boron compounds are disclosed in, for example, Japanese Unexamined Patent Application No. HEI 2-221967, and examples of useful quaternary ammonium salts with fluorine are disclosed in, for example, Japanese Unexamined Patent Application No. HEI 3-1162.

When adding charge control agents, the amount added is desirably in a range of 0.1 to 10 pbw, and preferably 0.5 to 5.0 pbw relative to 100 pbw of binder resin.

The volume-average particle size of the toner is desirably adjusted to 5 to 10 μm, and preferably 6 to 9 μm, from the perspective of the reproducibility of high resolution images.

The previously described toner may be used as a two-component toner when mixed with a carrier, or may be used as a monocomponent toner without a carrier.

The carrier used in combination with the toner may be any well known carrier used in conventional two-component developers, e.g., carriers formed of magnetic particles such as iron, ferrite and the like, resin-coated carriers comprising magnetic particles coated with resin, and binder type carriers formed of magnetic powder disperse in a binder resin. Among such carriers, it is desirable to use a resin-coated carrier using silicone resin, organopolysiloxane and vinyl monomer copolymer resin (graft resin), or polyester resin as a coating resin, or a binder type carrier using a polyester resin as a binder resin from the perspective of spent toner, and the use of a resin-coated carrier coated with resin obtained by reacting isocyanate with a copolymer resin of organopolysiloxane and vinyl monomer is particularly desirable from the perspectives of durability, environmental stability, and resistance to becoming spent. A monomer having a substituent such as hydroxyl or the like possessing reactivity to isocyanate is used as the aforementioned vinyl monomer. Furthermore, it is desirable that the carrier have a volume-average particle size of 20 to 60 μm from the perspective of maintaining high image quality and preventing carrier fog.

The aforementioned toner is suitable for use in full color image forming apparatuses such as digital full color image forming apparatuses using magenta toner, cyan toner, yellow toner, and black toner as toners, and which form electrostatic latent images by digital writing on the surface of a charged photosensitive member in dot units via a laser beam optical unit or optical shutter unit. Specific methods of image formation include methods wherein a process for forming electrostatic latent image of predetermined color on the surface of a photosensitive member, process for developing the electrostatic latent image with a predetermined toner, and process for transferring the toner image to an intermediate transfer member are sequentially executed for each color, and subsequently the overlaid toner image on the intermediate transfer member is transferred onto a recording sheet and fixed thereon, or methods wherein a process for forming electrostatic latent image of predetermined color on the surface of a photosensitive member, process for developing the electrostatic latent image with a predetermined toner, and process for transferring the toner image onto a recording sheet carried by intermediate transfer member are sequentially executed for each color, and subsequently the overlaid toner image on the recording sheet is fixed thereon, or methods wherein a process for forming electrostatic latent images of predetermined colors on the surface of a photosensitive member, and process for developing the electrostatic latent image with a predetermined toner are sequentially executed for each color, and the overlaid toner image formed on the surface of the photosensitive member is transferred onto a recording sheet and fixed thereon.

Although the present invention is described by way of specific examples below, the present invention is not limited to the following examples.

Production of Polyester Resin

Polyoxypropylene(2,2)-2,2-bis(4-hydroxyphenyl) propane (hereinafter referred to as "PO"), polyoxyethylene(2,0)-2,2-bis(4-hydroxyphenyl) propane (hereinafter referred to as "EO"), fumaric acid (hereinafter referred to as "FA"), and terephthalic acid (hereinafter referred to as "TPA") were combined to achieve a molar ratio of 5:5:5:4. The mixture was introduced into a 2 liter four-mouth flask to which a reflux condenser, moisture separator, nitrogen gas tube, thermometer, and mixing device were attached, and the flask was placed in a mantle heater. A reaction was induced by heating and mixing the mixture as nitrogen gas was introduced to the flask via the nitrogen gas tube. The acid values of the materials were measured during the reaction and the reaction conditions were followed until predetermined acid values were attained, at which time the reactions were terminated so as to obtain a polyester having number-average molecular weight Mn of 4800, and ratio of the weight-average molecular weight Mw to number-average molecular weight Mn of Mw/Mn=4.0, a glass transition temperature Tg of 58° C., and a softening point Tm of 100° C.

The values of Mw and Mn were measured using gel permeation chromatograph (model 807-IT; made by Nippon Bunkou Kogyo K.K.), by maintaining a column temperature of 40° C. and a using tetrahydrofuran as a carrier medium at a flow rate of 1 kg/cm$^3$, and dissolving a 30 mg sample in 20 ml tetrahydrofuran and introducing 0.5 mg of sample solution together with the carrier medium, and determining the polystyrene conversion.

The glass transition temperature Tg was measured using a differential scanning colorimeter (model DSC-200; made by Seiko Denshi K.K.), by measuring a 10 mg sample at a temperature elevation speed of 10° C./min using alumina as a reference, and designating the shoulder value at the main absorption peak as Tg. The softening point Tm was measured using a flow tester (model CFT-500; made by Shimadzu Seisakusho Co., Ltd.), by measuring a 1.0 g sample using a 1.0 mm by 1.0 mm die, temperature elevation speed of 3.0° C./min, preheating time 180 sec, load of 30 kg, measurement temperature range of 60° to 140° C., and designating the temperature at which half of the sample flowed as Tm.

Example of Production of Anatase Type Titania

Three types of aqueous titanium oxide having different particles sizes were obtained by changing the speed of hydrolysis in a process producing hydrous titanium oxide by sulfuric acid method. After washing the material was calcined at 300° C., to obtain anatase-type titania A having a average primary particle size of 50 nm and BET specific surface area of 100 m$^2$/g, anatase-type titania B having a average primary particle size of 70 nm and BET specific surface area of 75 m$^2$/g, and anatase-type titania C having a average primary particle size of 15 nm and BET specific surface area of 180 m$^2$/g.

EXAMPLE 1

The aforementioned polyester resin and cyan pigment (CI. Pigment blue 15-3; made by Toyo Ink Seizo K.K.) were mixed in a pressure kneader at a resin-to-pigment weight ratio of 7:3. The obtained mixture was cooled, and subsequently pulverized in a feather mill to obtain a pigment master batch.

After 93 pbw of the aforementioned polyester resin, 10 pbw of the aforementioned pigment master batch, and 2 pbw of charge control agent (salicylic acid zinc complex E-84; made by Orient Chemical Industries Co., Ltd.) were mixed in a Henschel mixer, the mixture was further mixed using a dual-shaft extrusion kneader. After the kneaded mixture was cooled, it was coarsely pulverized using a feather mill, finely pulverized using a jet mill, and classified to obtain toner particles having a volume-average particle size of 8.0 μm.

As the aforementioned titania A was mixed in an aqueous system at a rate of 2 wt %, n-butyltrimethoxy silane was added as a hydrophobicity imparting agent at a rate of 10 wt % relative to the titania micro particles. The mixture was dried, and pulverized to obtain hydrophobic titania having a BET specific surface area of 75 $m^2/g$, where k=52.5.

The aforementioned hydrophobic titania was added at a rate of 1.0 wt % to the obtained toner particles as exterior additive, and mixed in a Henschel mixer to obtain toner 1.

EXAMPLE 2

Toner 2 was produced as follows. In the same manner as in Example 1 with the exception that the amount of hydrophobicity imparting agent added as set at 15 wt % relative to the Titania A, hydrophobic titania having a BET specific surface area of 60 $m^2/g$ where k=37.7 was produced, and toner 2 was obtained in the same manner as in Example 1 with the exception that this hydrophobic titania was used.

EXAMPLE 3

Toner 3 was produced as follows. In the same manner as in Example 1 with the exception that the amount of hydrophobicity imparting agent added as set at 25 wt % relative to the Titania A, hydrophobic titania having a BET specific surface area of 46 $m^2/g$ where k=23.5 was produced, and toner 3 was obtained in the same manner as in Example 1 with the exception that this hydrophobic titania was used.

EXAMPLE 4

Toner 4 was produced as follows. In the same manner as in Example 1 with the exception that the amount of hydrophobicity imparting agent added as set at 15 wt % relative to the Titania B, hydrophobic titania having a BET specific surface area of 50 $m^2/g$ where k=34.0 was produced, and toner 4 was obtained in the same manner as in Example 1 with the exception that this hydrophobic titania was used.

Reference Example 1

Toner 5 was produced as follows. In the same manner as in Example 1 with the exception that the amount of hydrophobicity imparting agent added as set at 10 wt % relative to the Titania C, hydrophobic titania having a BET specific surface area of 112 $m^2/g$ where k=37.0 was produced, and toner 5 was obtained in the same manner as in Example 1 with the exception that this hydrophobic titania was used.

Reference Example 2

Toner 6 was produced as follows. In the same manner as in Example 1 with the exception that the amount of hydrophobicity imparting agent added as set at 15 wt % relative to the Titania C, hydrophobic titania having a BET specific surface area of 100 $m^2/g$ where k=25.0 was produced, and toner 6 was obtained in the same manner as in Example 1 with the exception that this hydrophobicity imparting titania was used.

Reference Example 3

Toner 7 was produced as follows. In the same manner as in Example 1 with the exception that the amount of hydrophobicity imparting agent added as set at 25 wt % relative to the Titania C, hydrophobic titania having a BET specific surface area of 86 $m^2/g$ where k=11.0 was produced, and toner 7 was obtained in the same manner as in Example 1 with the exception that this hydrophobic titania was used.

Reference Example 4

Toner 8 was produced in the same manner as in Example 1 with the exception that the hydrophobic titania obtained as follows. Mixing MT150A (rutile-type titania; average primary particle size of 15 nm; made by Tayca Co., Ltd.) in an aqueous system, adding n-butyltrimethoxy silane as a hydrophobicity imparting agent at a rate of 15 wt % relative to the titania micro particles, drying the mixture, and pulverized to obtain hydrophobic titania having a BET specific surface area of 64 $m^2/g$, where k=−11.0.

Reference Example 5

Toner 9 was produced in the same manner as in Example 1 with the exception that the hydrophobic titania obtained as follows. Mixing MT500B (rutile-type titania; average primary particle size of 35 nm; made by Tayca Co., Ltd.) in an aqueous system, adding n-butyltrimethoxy silane as a hydrophobicity imparting agent at a rate of 15 wt % relative to the titania micro particles, drying the mixture, and pulverized to obtain hydrophobic titania having a BET specific surface area of 35 $m^2/g$, where k=2.9.

Reference Example 6

Toner 10 was produced in the same manner as in Example 1 with the exception that hydrophobic rutile-type titania T805 (average primary particle size of 30 nm, BET specific surface area of 35 $m^2/g$, where k=−2.5; made by Nippon Aerosil K.K.) was used as the hydrophobic titania.

Reference Example 7

Toner 11 was produced as follows. Hydrophobic titania having a BET specific surface area of 95 $m^2/g$, where k=72.5, was obtained in the same manner as in Example 1 with the exception that the amount of hydrophobicity imparting agent was set at 15 wt % relative to the anatase-type titania (average primary particle size of 50 nm, BET specific surface area of 120 $m^2/g$) obtained by adjusting the pulverizing time and temperature in the aforementioned titania production example, and toner 11 was obtained in the same manner as in Example 1 with the exception that this hydrophobic titania was used.

Reference Example 8

Toner 12 was produced in the same manner as in Reference Example 7 with the exception that the hydrophobic titania (BET specific surface area of 20 $m^2/g$, k=−2.5) obtained by adding 100 wt % n-butyltrimethoxy silane as a hydrophobicity imparting agent to the titania micro particles.

Example of Production of Carrier 100 pbw of methylethyl ketone was introduced into a 500 ml flask provided with a mixer, condenser, thermometer, nitrogen tube, and drip feeder. A solvent obtained separately under nitrogen atmosphere at 80° C. and comprising 36.7 pbw methyl methacrylate, 5.1 pbw 2-hydroxy ethyl methacrylate, 58.2 pbw 3-methacryloxypropyltris (trimethylsiloxy) siloxane, and 1 pbw 1,1'-azobis (cyclohexane-1-carbonitril) dissolved in 100 pbw methylethyl ketone was dripped into a reactor for 2 hr, and maintained for 5 hr.

After the obtained resin was adjusted with isophorone diisocyanate/trimethylolpropane adduct (IPDI/TMP type, NCO %=6.1%) as a crosslinking agent to attain an OH/NCO molar ratio of 1/1, it was diluted with methylethyl ketone to obtain a coating resin solution having a solid ratio of 3 wt %.

Using pulverized ferrite powder F-300 (average particle size: 50 μm; made by Powder Tech K.K.) as a core material, the aforementioned coating resin solution was applied to the core material using a spray coater (made by Okada Seiko K.K.) to obtain 1.5 wt % coating resin on the core material, then dried. The obtained carrier was allowed to stand for 1 hr at 160° C. in an oven with internal air circulation to bake. After cooling, the bulk ferrite carrier was cracked using a sieve shaker having mesh screen of 106 μm and 75 μm to obtain resin coated carrier.

Flow Characteristics

The apparent specific gravity (g/cc) of each toner was measured using a powder tester (made by Hosokawa Micron K.K.). Measurement results are shown in Table 1.

Flocculation Noise (nonprinting white spots)

Developers were produced by mixing each of the aforementioned toners and carrier obtained in the aforementioned production example to attain a toner mix ratio of 7 wt %. These developers were used in a digital full color copying machine model CF80 (made by Minolta Co., Ltd.) To make 3,000 prints of an image having a black/white ratio of 15%. A solid image printed on the entire surface of an A3 size CF80 sheet (made by Minolta Co., Ltd.) was checked initially and at the final printing, and the appearance of nonprinting white spots 2 $mm^2$ and larger caused by inadequate transfer due to flocculation was evaluated as X, whereas the absence of the same was evaluated as O. The results are shown in Table 1.

Fog

The developers were adjusted in the same manner as in the aforementioned flocculation noise evaluation. Using the CF80 copying machine, an image having a black/white ratio of 15% was printed and the white background of the images were visually evaluated. Images without fog were evaluated as O, slight fog which posed no practical problem was evaluated as Δ, and severe fog was evaluated as X. The results are shown in Table 1.

Environmental Stability

The developers were adjusted in the same manner as in the aforementioned flocculation noise evaluation. Using the CF80 copying machine, 3,000 prints were made of an image having a black/white ratio of 15% under L/L conditions (10° C., 15%) and H/H conditions (30° C., 85%). After printing under L/L conditions, the density ID of the obtained image was measured using a markbase reflective densitometer model RD-900. Image density of 1.2 and higher was evaluated as O, image density of 1.0 and greater but less than 1.2 was evaluated as Δ, and image density less than 1.0 was evaluated as X.

After printing under H/H conditions, the white background of the obtained image was visually evaluated. Images without fog were evaluated as O, slight fog which posed no practical problem was evaluated as Δ, and severe fog was evaluated as X. The results are shown in Table 1.

TABLE 1

| | Flow | Nonprinting white spots | | | Environmental stability | |
|---|---|---|---|---|---|---|
| | | | After | | | |
| | (g/cc) | Initial | printing | Fog | L/L | H/H |
| Ex. 1 | 0.412 | ○ | ○ | ○ | ○ | ○ |
| Ex. 2 | 0.422 | ○ | ○ | ○ | ○ | ○ |
| Ex. 3 | 0.430 | ○ | ○ | ○ | ○ | ○ |
| Ex. 4 | 0.415 | ○ | ○ | ○ | ○ | ○ |
| Ref. 1 | 0.428 | ○ | x | ○ | ○ | ○ |
| Ref. 2 | 0.440 | ○ | x | ○ | ○ | ○ |
| Ref. 3 | 0.444 | ○ | x | ○ | ○ | ○ |
| Ref. 4 | 0.410 | x | x | Δ | ○ | x |
| Ref. 5 | 0.384 | x | x | x | ○ | x |
| Ref. 6 | 0.390 | x | x | Δ | ○ | x |
| Ref. 7 | 0.385 | ○ | ○ | x | ○ | x |
| Ref. 8 | 0.395 | x | x | ○ | x | ○ |

EXAMPLE 5

The aforementioned polyester resin and cyan pigment (CI. Pigment blue 15-3; made by Toyo Ink Seizo K.K.) were mixed in a pressure kneader at a resin-to-pigment weight ratio of 7:3. The obtained mixture was cooled, and subsequently pulverized in a feather mill to obtain a pigment master batch.

After 93 pbw of the aforementioned polyester resin, 10 pbw of the aforementioned pigment master batch, and 2 pbw of charge control agent (salicylic acid zinc complex E-84; made by Orient Chemical Industries Co., Ltd.) were mixed in a Henschel mixer, the mixture was further mixed using a dual-shaft extrusion kneader. After the obtained mixture was cooled, it was coarsely pulverized using a feather mixer, finely pulverized using a jet mill, and classified to obtain toner particles having a volume-average particle size of 8.0 μm.

As the aforementioned titania A was mixed in an aqueous system at a rate of 2 wt %, n-butyltrimethoxysilane was added as a hydrophobicity imparting agent at a rate of 10 wt % relative to the titania micro particles. The mixture was dried, and pulverized to obtain hydrophobic titania having a BET specific surface area of 75 $m^2/g$, where k=52.5.

The aforementioned hydrophobic titania was added at a rate of 0.7 wt % and hydrophobic silica (H2000; average primary particle size 15 nm, BET specific surface area 140 $m^2/g$; made by Wakker Co.) was added at a rate of 0.4 wt % to the obtained toner particles as exterior additives, and mixed in a Henschel mixer to obtain toner 13.

EXAMPLE 6

Toner 14 was produced as follows. Hydrophobic titania having a BET specific surface area of 60 $m^2/g$, where k=37.5, was obtained in the same manner as in Example 5 with the exception that the amount of hydrophobicity imparting agent was 15 wt % relative to titania A. Toner 14 was produced in the same manner as in Example 5 with the exception that this hydrophobic titania was used.

EXAMPLE 7

Toner 15 was produced as follows. Hydrophobic titania having a BET specific surface area of 46 $m^2/g$, where k=23.5, was obtained in the same manner as in Example 5 with the exception that the amount of hydrophobicity imparting agent was 25 wt % relative to titania A. Toner 15 was produced in the same manner as in Example 5 with the exception that this hydrophobic titania was used.

EXAMPLE 8

Toner 16 was produced in the same manner as in Example 7 with the exception that 1.0 wt % titania and 0.2 wt % silica were added to the toner particles.

EXAMPLE 9

Toner 17 was produced as follows. Hydrophobic titania having a BET specific surface area of 50 $m^2/g$, where k=34.0, was obtained in the same manner as in Example 5 with the exception that the amount of hydrophobicity imparting agent was 15 wt % relative to titania B. Toner 17 was produced in the same manner as in Example 5 with the exception that 0.7 wt % of this hydrophobic titania and 0.4 wt % silica R972 (average primary particle size 16 nm, BET specific surface area 110 $m^2/g$; made by Nippon Aerosil Co.) subjected to hydrophobicity imparting processing by dimethyldichlorosilane was used.

Reference Example 9

Toner 18 was produced as follows. Hydrophobic titania having a BET specific surface area of 100 $m^2/g$, where k=25, was obtained in the same manner as in Example 5 with the exception that the amount of hydrophobicity imparting agent was 15 wt % relative to titania C. Toner 18 was produced in the same manner as in Example 5 with the exception that this hydrophobic titania was used.

Reference Example 10

Toner 19 was produced in the same manner as in Example 5 with the exception that hydrophobic rutile-type titania T805 (average primary particle size of 30 nm, BET specific surface area of 35 $m^2/g$, where k=−2.5; made by Nippon Aerosil Co.) was used as the hydrophobic titania.

Reference Example 11

Toner 20 was produced in the same manner as in Example 5 with the exception that the hydrophobic titania used was obtained by mixing MT150A (rutile-type titania; average primary particle size of 15 nm; made by Tayca, Co., Ltd.) in an aqueous system and adding n-butyltrimethoxy silane as a hydrophobicity imparting agent at a rate of 15 wt % relative to the titania micro particles. The mixture was dried, and pulverized to obtain hydrophobic titania having a BET specific surface area of 64 $m^2/g$, where k=−11.0.

Reference Example 12

Toner 21 was produced in the same manner as in Reference Example 11 with the exception that the amount of added titania was 0.7 wt % and the amount of added silica was 0.7 wt % relative to the toner particles.

Reference Example 13

Toner 22 was produced in the same manner as in Example 1 with the exception that the hydrophobic titania used was obtained by mixing MT500B (rutile-type titania; average primary particle size of 35 nm; made by Tayca Co., Ltd.) in an aqueous system and adding n-butyltrimethoxy silane as a hydrophobicity imparting agent at a rate of 15 wt % relative to the titania micro particles. The mixture was dried, and pulverized to obtain hydrophobic titania having a BET specific surface area of 35 $m^2/g$, where k=2.9.

Reference Example 14

Toner 23 was produced in the same manner as in Example 5 with the exception that silica R809 (average primary particle size of 40 nm, BET specific surface area of 35 $m^2/g$; made by Nippon Aerosil Co.) subjected to hydrophobicity imparting processing using hexamethyldisilazane was used as the hydrophobic silica.

Flow Characteristics

The apparent specific gravity (g/cc) of each toner was measured using a powder tester (made by Hosokawa Micron K.K.). Measurement results are shown in Table 2.

Flocculation Noise (nonprinting white spots)

Developers were produced by mixing each of the aforementioned toners and carrier obtained in the aforementioned production example to attain a toner mix ratio of 7 wt %. These developers were used in a digital full color copying machine model CF80 (made by Minolta Co., Ltd.) to make 5,000 prints of an image having a black/white ratio of 15%. A solid image printed on the entire surface of an A3 size CF80 sheet was checked initially and at the final printing, and the appearance of nonprinting white spots 2 $mm^2$ and larger caused by inadequate transfer due to flocculation was evaluated as X, whereas the absence of the same was evaluated as O. The results are shown in Table 2.

Fog

The developers were adjusted in the same manner as in the aforementioned flocculation noise evaluation. Using the CF80 copying machine, 5,000 prints of an image having a black/white ratio of 15% were printed and the white background of the initial and final images were visually evaluated. Images without fog were evaluated as O, slight fog which posed no practical problem was evaluated as Δ, and severe fog was evaluated as X. The results are shown in Table 2.

Environmental Stability

The developers were adjusted in the same manner as in the aforementioned flocculation noise evaluation. Using the CF80 copying machine, 5,000 prints were made of an image having a black/white ratio of 15% under L/L conditions (10° C., 15%) and H/H conditions (30° C., 85%). After printing under L/L conditions, the density ID of the obtained image was measured using a markbase reflective densitometer model RD-900. Image density of 1.2 and higher was evaluated as O, image density of 1.0 and greater but less than 1.2 was evaluated as Δ, and image density less than 1.0 was evaluated as X.

After printing under H/H conditions, the white background of the obtained image was visually evaluated. Images without fog were evaluated as O, slight fog which posed no practical problem was evaluated as Δ, and severe fog was evaluated as X. The results are shown in Table 2.

Filming on Photosensitive Member

The developers were adjusted in the same manner as in the aforementioned flocculation noise evaluation. Using the CF80 copying machine, 5,000 prints were made of an image having a black/white ratio of 15%. The surface of the photosensitive member was visually evaluated at initial and final printings. The absence of filming was evaluated as O, slight filming was evaluated as Δ, and severe filming was evaluated as X. The results are shown in Table 2.

Storage Heat Resistance 5 g of toner was stored at 50° C. for 24 hr in a glass bottle; the absence of toner flocculation was evaluated as O, slight flocculation which posed no practical problem was evaluated as Δ, and severe flocculation was evaluated as X. The results are shown in Table 2.

TABLE 2

| | Flow | White spots | | Fog | | Environmental Stability | | Filming | | Heat resistance |
|---|---|---|---|---|---|---|---|---|---|---|
| | (g/cc) | Initial | Final | Initial | Final | L/L | H/H | Initial | Final | Stability |
| Ex. 5 | 0.430 | ○ | ○ | ○ | ○ | ○ | ○ | ○ | ○ | ○ |
| Ex. 6 | 0.431 | ○ | ○ | ○ | ○ | ○ | ○ | ○ | ○ | ○ |
| Ex. 7 | 0.433 | ○ | ○ | ○ | ○ | ○ | ○ | ○ | ○ | ○ |
| Ex. 8 | 0.435 | ○ | ○ | ○ | ○ | ○ | ○ | ○ | ○ | ○ |
| Ex. 9 | 0.422 | ○ | ○ | ○ | Δ | ○ | Δ | ○ | ○ | ○ |
| Ref. 9 | 0.445 | ○ | x | ○ | ○ | x | ○ | ○ | ○ | ○ |
| Ref. 10 | 0.410 | x | x | x | x | ○ | x | ○ | ○ | ○ |
| Ref. 11 | 0.414 | x | x | x | x | ○ | x | ○ | ○ | ○ |
| Ref. 12 | 0.441 | ○ | x | ○ | ○ | ○ | ○ | ○ | x | ○ |
| Ref. 13 | 0.397 | x | x | x | x | ○ | x | ○ | ○ | ○ |
| Ref. 14 | 0.415 | ○ | x | ○ | ○ | ○ | ○ | ○ | ○ | x |

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. A toner for developing electrostatic latent images comprising:

(a) colored resin particles which include a binder resin and a colorant; and (b) hydrophobic titania micro particles which are obtained by surface treating of anatase-type titania micro particles having average primary particle size of 30 to 90 nm with a hydrophobicity imparting agent and satisfy following relationship:

$$S=1125/D+k$$

wherein S expresses BET specific surface area ($m^2/g$) of hydrophobic titania micro particles, D expresses average primary particle size (nm) of anatase-type titania micro particles, and k expresses a constant of 0 to 60.

2. The toner as claimed in claim 1 wherein the average primary particle size of anatase-type titania micro particles is in the range of 35 to 80 nm, and the constant k is in the range of 10 to 55.

3. The toner as claimed in claim 1 wherein said anatase-type titania micro particles have a disk-like shape, and said hydrophobic titania micro particles are contained in an amount of 0.1 to 3 percent by weight relative to the colored resin particles.

4. The toner as claimed in claim 3 wherein said hydrophobic titania micro particles are obtained by mixing anatase-type titania micro particles with hydrophobicity imparting agent in an aqueous system, drying the mixed titania micro particles, and pulverizing into respective particles.

5. A toner for developing electrostatic latent images comprising:

(a) colored resin particles which include a binder resin and a colorant;

(b) hydrophobic silica micro particles which are obtained by surface treating of silica micro particles having average primary particle size of 5 to 25 nm with a hydrophobicity imparting agent; and (c) hydrophobic titania micro particles which are obtained by surface treating of anatase-type titania micro particles having average primary particle size of 30 to 90 nm with a hydrophobicity imparting agent and satisfy following relationship:

$$S=1125/D+k$$

wherein S expresses BET specific surface area ($m^2/g$) of hydrophobic titania micro particles, D expresses average primary particle size (nm) of anatase-type titania micro particles, and k expresses a constant of 0 to 60.

6. The toner as claimed in claim 5 wherein the BET specific surface area of said hydrophobic silica micro particles is in the range of 80 to 250 $m^2/g$.

7. The toner as claimed in claim 6 wherein the average primary particle size of said anatase-type titania micro particles is in the range of 35 to 80 nm, and the constant k is in the range of 10 to 55.

8. The toner as claimed in claim 7 wherein the average primary particle size of said anatase-type titania micro is in the range of 40 to 70 nm, the constant k is in the range of 15 to 45, and the BET specific surface area of said hydrophobic silica micro particles in the range of 100 to 200 $m^2/g$.

9. The toner as claimed in claim 6 wherein said hydrophobicity imparting agent for silica micro particles is hexamethyldisilazane.

10. The toner as claimed in claim 6 wherein total amount of said hydrophobic silica micro particles and said hydrophobic titania micro particles is in the range of 0.3 to 3 percent by weight relative to the colored resin particles, and weight ratio of said hydrophobic titania micro particles to said hydrophobic silica micro particles is in the range of 10:1 to 10:9.

11. The toner as claimed in claim 10 wherein the total amount of hydrophobic silica micro particles and hydrophobic titania micro particles is in the range of 0.5 to 2 percent by weight relative to the colored resin particles, and the weight ratio of hydrophobic titania micro particles to hydrophobic silica micro particles is in the range of 10:2 to 10:7.

12. A toner for developing electrostatic latent images comprising:

(a) colored resin particles which include a binder resin and a colorant, wherein said binder resin has number-average molecular weight of 3000 to 6000, ratio of weight-average molecular weight to number-average molecular weight (Mw/Mn) of 2 to 6, glass transition temperature of 50° to 70° C., and softening point of 90° to 110° C.;

(b) hydrophobic titania micro particles which are obtained by surface treating of anatase-type titania micro particles having average primary particle size of 30 to 90 nm with a hydrophobicity imparting agent and satisfy following relationship:

$S=1125/D+k$ wherein S expresses BET specific surface area ($m^2/g$) of hydrophobic titania micro particles, D expresses average primary particle size (nm) of anatase-type titania micro particles, and k expresses a constant of 0 to 60.

13. The toner as claimed in claim 12 which further comprises hydrophobic silica micro particles, wherein said hydrophobic silica micro particles are obtained by surface treating of silica micro particles having a primary average average particle size of 5 to 25 nm with a hydrophobicity imparting agent, and have BET specific surface area of 80 to 250 $m^2/g$.

14. The toner as claimed in claim 13 wherein the average primary particle size of said anatase-type titania micro particles is in the range of 35 to 80 nm, and the constant k is in the range of 10 to 55.

15. The toner as claimed in claim 14 wherein the average primary particle size of said anatase-type titania micro is in the range of 40 to 70 nm, the constant k is in the range of 15 to 45, and the BET specific surface area of said hydrophobic silica micro particles is in the range of 100 to 200 $m^2/g$.

16. The toner as claimed in claim 13 wherein said hydrophobicity imparting agent for silica micro particles is hexamethyldisilazane.

17. The toner as claimed in claim 13 wherein total amount of said hydrophobic silica micro particles and said hydrophobic micro particles is in the range of 0.3 to 3 percent by weight relative to the colored resin particles, and weight ratio of said hydrophobic titania micro particles to said hydrophobic silica micro particles is in the range of 10:1 to 10:9.

18. The toner as claimed in claim 17 wherein the total amount of hydrophobic silica micro particles and hydrophobic titania micro particles is in the range of 0.5 to 2 percent by weight relative to the colored resin particles, and the weight ratio of hydrophobic titania micro particles to hydrophobic silica micro particles 10:2 to 10:7.

19. The toner as claimed in claim 13 wherein said binder resin has the number-average molecular weight of 3500 to 5500, the ratio of Mw/Mn of 2.5 to 5.5, the glass transition temperature of 55° to 65° C., and the softening point of 90° to 105° C.

20. The toner as claimed in claim 13 which is used in a full-color image forming apparatus for forming a multi-color image, and comprises at least one kind of toner selected from the group consisting of magenta toner, cyan toner, yellow toner and black toner.

21. A toner for developing electrostatic latent images comprising:

(a) colored resin particles which include a binder resin and a colorant; and (b) hydrophobic titania micro particles which are obtained by surface treating of anatase-type titania micro particles having average primary particle size of 30 to 90 nm with a hydrophobicity imparting agent and satisfy following relationship:

$S=1125/D+k$ wherein S expresses BET specific surface area ($m^2/g$) of hydrophobic titania micro particles, D expresses average primary particle size (nm) of anatase-type titania micro particles, and k expresses a constant of 10 to 55, said hydrophobic titania micro particles contained in an amount of 0.1 to 3 percent by weight relative to the colored resin particles.

22. The toner as claimed in claim 21, wherein the average primary particle size of anatase-type titania micro particles is in the range of 35 to 80 nm, and the constant k is in the range of 15 to 55.

23. The toner as claimed in claim 21, wherein said anatase-type titania micro particles have a disk-like shape.

* * * * *